US008317638B2

(12) United States Patent
Madson et al.

(10) Patent No.: US 8,317,638 B2
(45) Date of Patent: Nov. 27, 2012

(54) GOLF BALL DIMPLES HAVING CIRCUMSCRIBED PRISMATOIDS

(75) Inventors: Michael R. Madson, Pawtucket, RI (US); Nicholas M. Nardacci, Bristol, RI (US)

(73) Assignee: Acushnet Company, Fairhaven, MA (US)

( * ) Notice: Subject to any disclaimer, the term of this patent is extended or adjusted under 35 U.S.C. 154(b) by 529 days.

(21) Appl. No.: 12/584,595

(22) Filed: Sep. 9, 2009

(65) Prior Publication Data

US 2011/0059813 A1 Mar. 10, 2011

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS

| | | | | |
|---|---|---|---|---|
| 5,158,300 | A * | 10/1992 | Aoyama | 473/384 |
| 6,162,136 | A | 12/2000 | Aoyama | |
| 6,569,038 | B2 | 5/2003 | Sullivan | |
| 6,632,150 | B1 | 10/2003 | Ogg | |
| 6,872,154 | B2 | 3/2005 | Shannon et al. | |
| 6,905,426 | B2 * | 6/2005 | Morgan et al. | 473/383 |
| 6,958,020 | B1 | 10/2005 | Ogg et al. | |
| 7,056,233 | B2 * | 6/2006 | Aoyama | 473/383 |
| 7,128,666 | B2 * | 10/2006 | Veilleux et al. | 473/384 |
| 7,207,905 | B2 * | 4/2007 | Aoyama | 473/384 |
| 7,223,183 | B2 * | 5/2007 | Sajima | 473/383 |
| 7,867,109 | B2 * | 1/2011 | Sullivan et al. | 473/383 |

* cited by examiner

*Primary Examiner* — Raeann Gorden
(74) *Attorney, Agent, or Firm* — D. Michael Burns

(57) ABSTRACT

The present invention relates to golf balls, specifically, to a golf ball with multifaceted depressions comprising two discrete geometries surrounded by a first perimeter. A second perimeter is circumscribed within the first and surrounds prismatoid depressions or protrusions. Primarily the first and second perimeters are circular and the depressions or protrusions are based on a polyhedral prismatoid having a minimum of three and a maximum of twelve edges, wherein the ratio of the first and second diameters is between 0.25 to 0.90.

8 Claims, 7 Drawing Sheets

GOLF BALL DIMPLES HAVING CIRCUMSCRIBED PRISMATOIDS

FIELD OF THE INVENTION

The present invention relates to golf balls, specifically, to a golf ball with multifaceted depressions comprising two discrete geometries.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities and thus, different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, there is a reduction in the area of the wake, an increase in the pressure behind the ball, and a substantial reduction in drag. It is the circumference portion of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. Also, the circumference portion of each dimple is important in optimizing this flow phenomenon.

By using dimples to decrease drag and increase lift, almost every golf ball manufacturer has increased their golf ball flight distances. In order to optimize ball performance, it is desirable to have a large number of dimples, thus a large amount of dimple circumference, which are evenly distributed around the ball. In arranging the dimples, an attempt is made to minimize the space between dimples, because such space does not improve aerodynamic performance of the ball. In practical terms, this usually translates into 300 to 500 circular dimples with a conventional-sized dimple having a diameter that ranges from about 0.120 inches to about 0.180 inches.

One approach for maximizing the aerodynamic performance of golf balls is suggested in U.S. Pat. No. 6,162,136 ("the '136 patent), wherein a preferred solution is to minimize the land surface or undimpled surface of the ball. The '136 patent also discloses that this minimization should be balanced against the durability of the ball. Since as the land surface decreases, the susceptibility of the ball to premature wear and tear by impacts with the golf club increases. Hence, there remains a need in the art for a more aerodynamic and durable golf ball.

SUMMARY OF THE INVENTION

Accordingly, the present invention is directed to a golf ball with improved dimples. The present invention is also directed to a golf ball with improved aerodynamic characteristics. These and other embodiments of the prevent invention are realized by a golf ball comprising a spherical outer land surface and a plurality of dimples formed thereon.

The invention provides for at least one dimple having multifaceted depressions which include two distinct geometries. A first perimeter surrounds prismatoid depressions or protrusions and a second, smaller perimeter is circumscribed within the first. Primarily the first and second perimeters are circular and the depressions or protrusions are based on a polyhedral prismatoid.

In every embodiment of the invention the prismatoid maintains a minimum of three and a maximum of twelve edges, wherein the ratio of the first and second diameters is defined by:

$$r_c = \frac{D_S}{D_D}$$

wherein:

rc is the circle ratio $D_D$ is the diameter of the first circular perimeter $D_S$ is the diameter of the second circular perimeter and the range of values for rc is about 0.25 to about 0.90.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
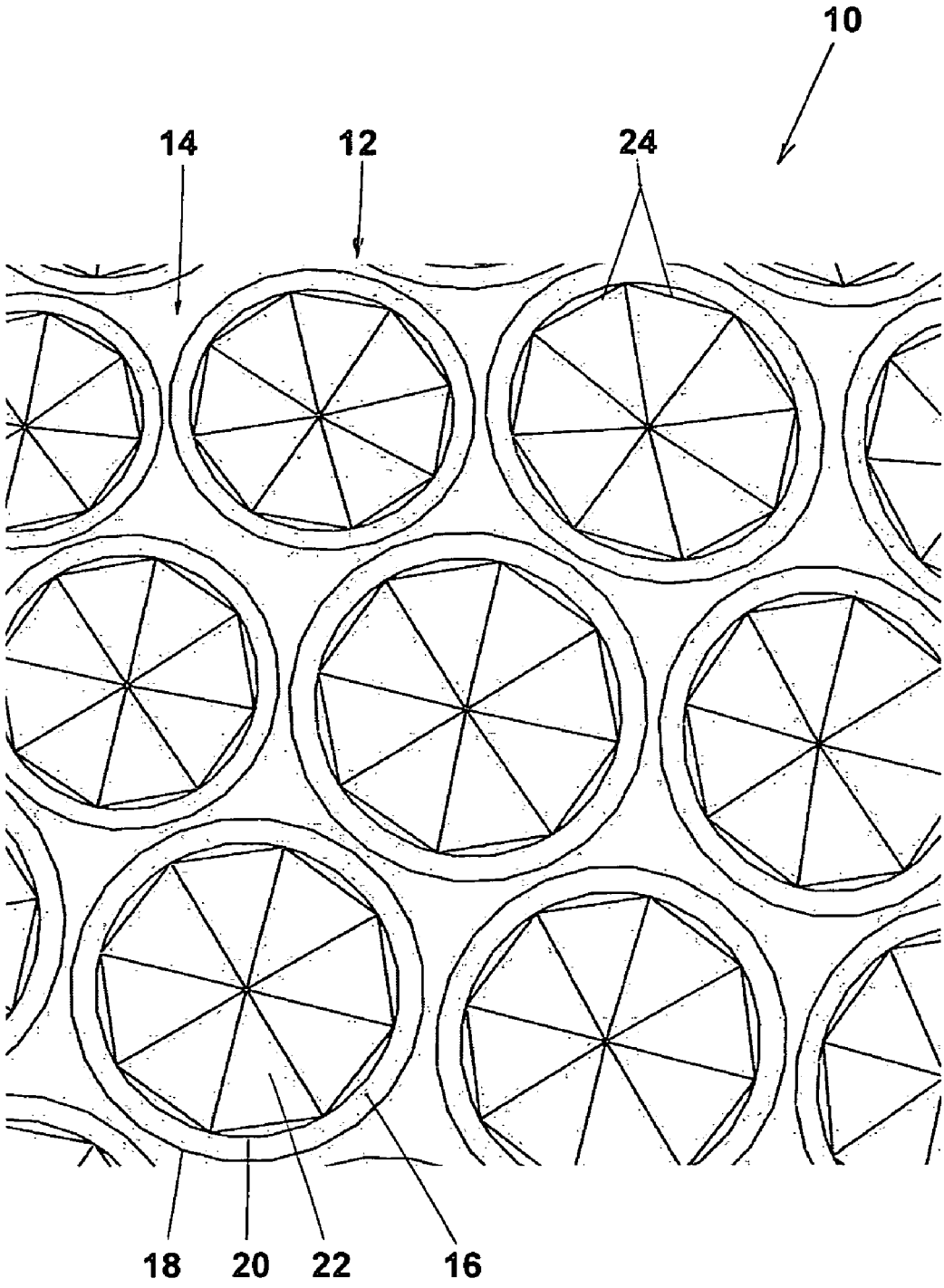
FIG. 1 is a partial surface of a golf ball having an eight-edged prismatoid depression in each dimple.

As shown generally in FIG. 1, where like numbers designate like parts, reference number 10 broadly designates a partial surface of a golf ball 10 having a plurality of dimples 12 separated by outer undimpled or land surface 14. In accordance to one aspect of the present invention as shown in FIG. 1, the dimples 12 are formed as multifaceted depressions, each dimple comprising two discrete geometries; a first depression 16 having a first larger circular perimeter 18 and, a second, smaller circular diameter 20 concentric and circumscribed within the larger circular perimeter 18 and containing a prismatoid depression 22.

The dimples on a golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, there is a reduction in the area of the wake, an increase in the pressure behind the ball, and a substantial reduction in drag. It is the circumference portion of each dimple, where the dimple wall drops away from the outer surface of the ball, which actually creates the turbulence in the boundary layer.

The present invention provides dimples with inscribed polyhedral prismatoids as a means to further tune the aerodynamic flight characteristics of conventional dimple layouts having depressions with circular perimeter boundaries. Further, these profiles provide an aesthetically unique and novel dimple pattern. The dimples described herein begin with an initial dimple profile where the boundary perimeter is a circular projection on the spherical surface of the golf ball. It is to be appreciated that this would not only include spherical, but also conical, catenary and the like. Then, a second concentric circular projection within the dimple perimeter located below the chord plane of the dimple and marking the termination of the initial dimple surface. Within the second concentric circular projection is a depression or protrusion based on a polyhedral prismatoid whose base is normal to the dimple axis and circumscribed by the second concentric circle. Further, the extent of the prismatoid does not intersect the spherical ball surface. Preferred prismatoids consist of pyramids, cupolas and frusta.

To maintain adjustability of dimple parameters, the base of the prismatoid maintains a minimum of three and a maximum of twelve edges ($N_E$):

$$3<N_E<12 \qquad \text{Equation 1}$$

Figure 2:
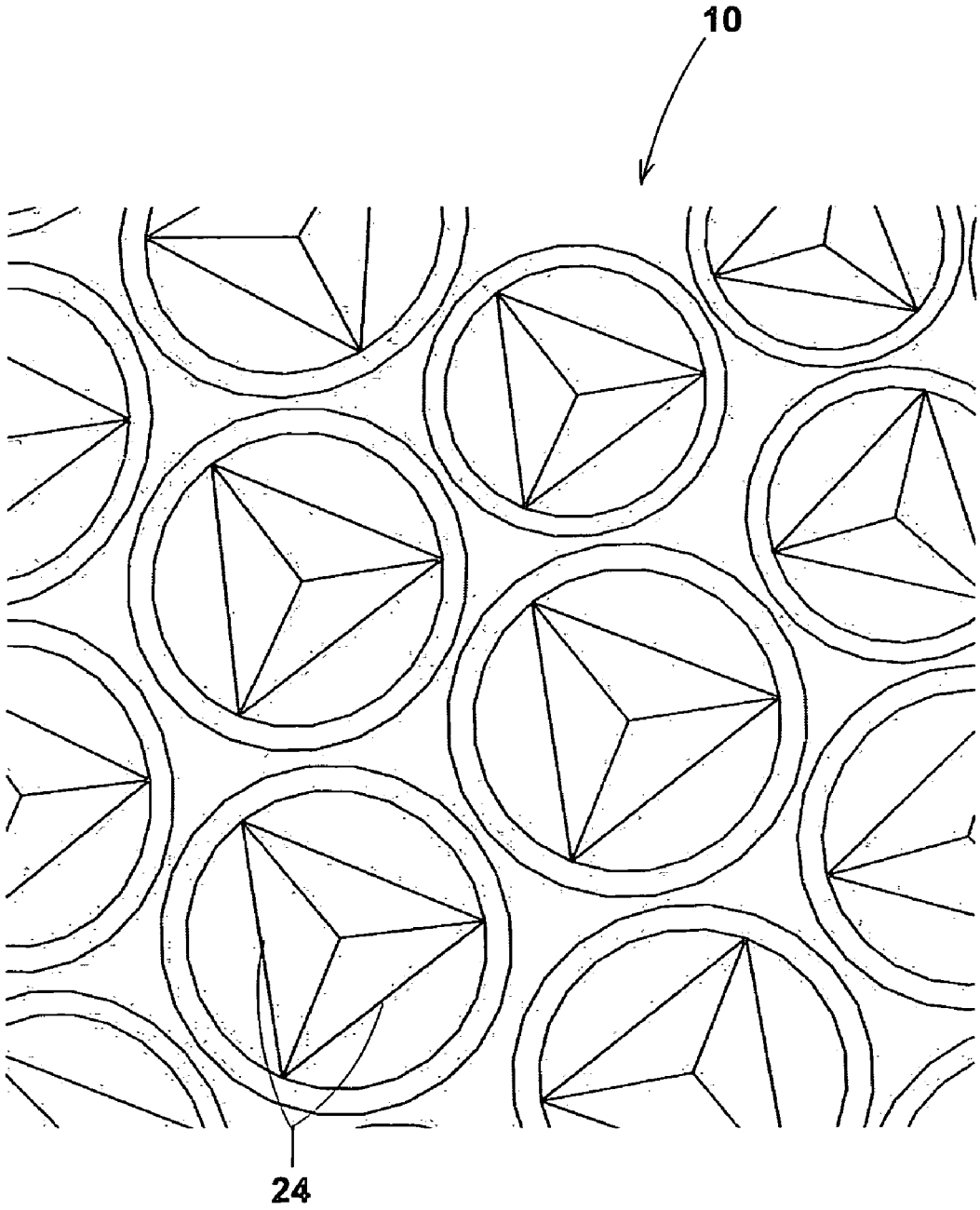
FIG. 2 is a partial surface of a golf ball having a three-edged prismatoid depression in each dimple.

An example of a dimple prismatoid having eight (8) edges 24 is shown in FIG. 1, while one having 3 edges 24 is shown in FIG. 2.

To allow for manufacturing and adjustability of the dimple, the shape must adhere to a particular circle ratio (rc), such that the ratio of diameters ($D_D$) and ($D_S$) is:

$$r_c = \frac{D_S}{D_D} \qquad \text{Equation 2}$$

The preferable range of values for rc is:

$$0.25<rc<0.90 \qquad \text{Equation 3}$$

Figure 3:
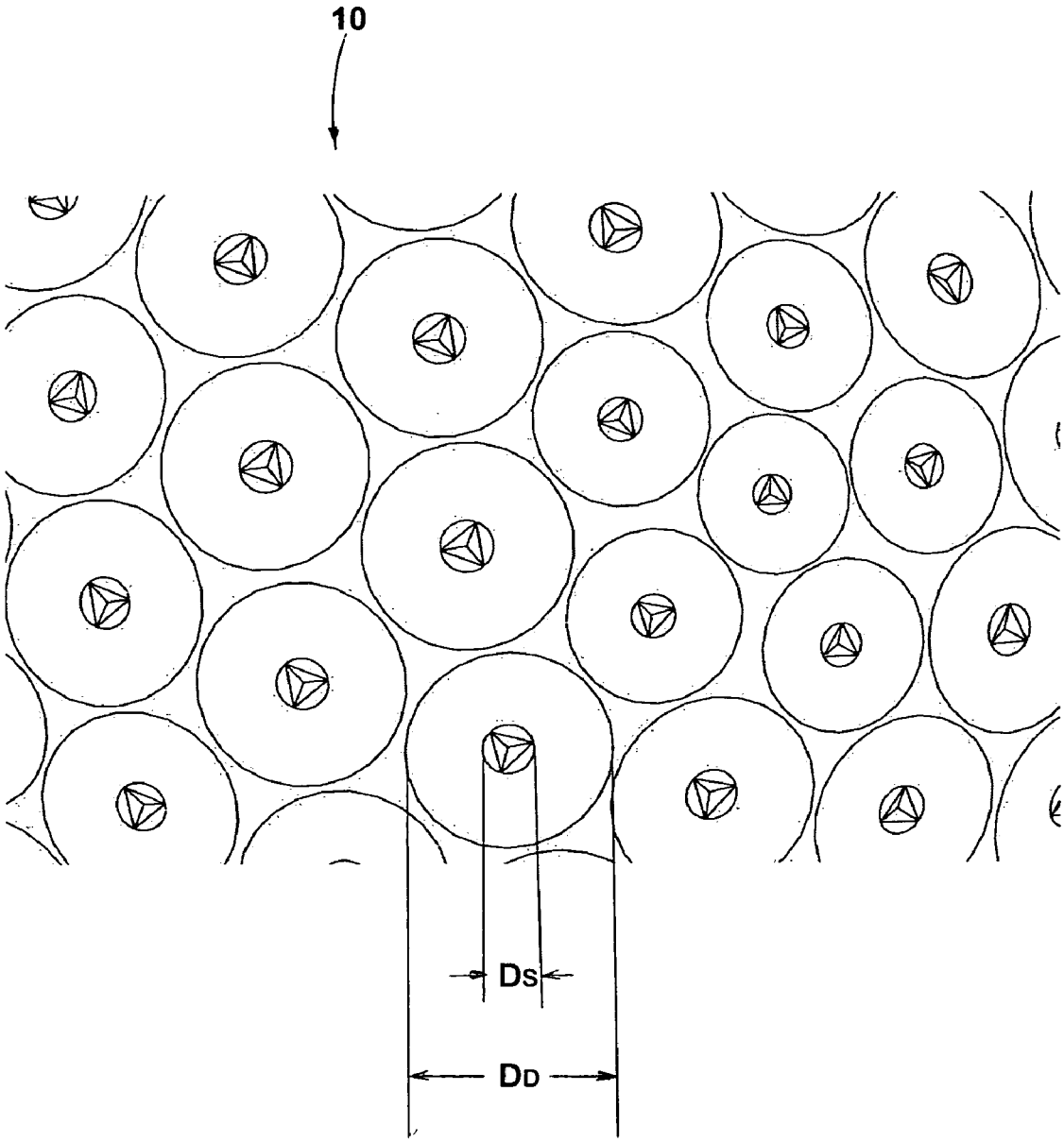
FIG. 3 is a partial surface of a golf ball having a circle ratio of 0.25.
Figure 4:
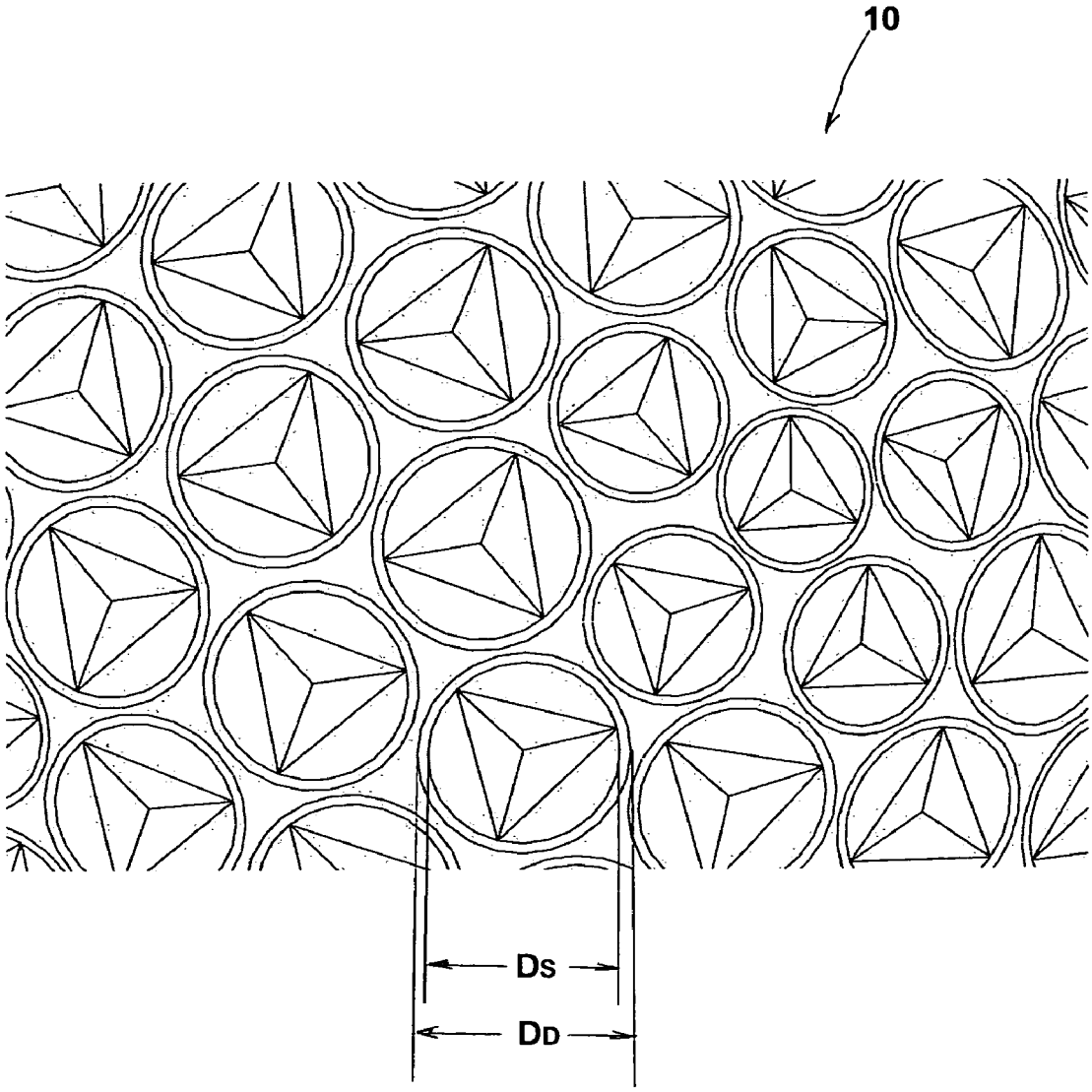
FIG. 4 is a partial surface of a golf ball having a circle ratio of 0.90.
Figure 5:
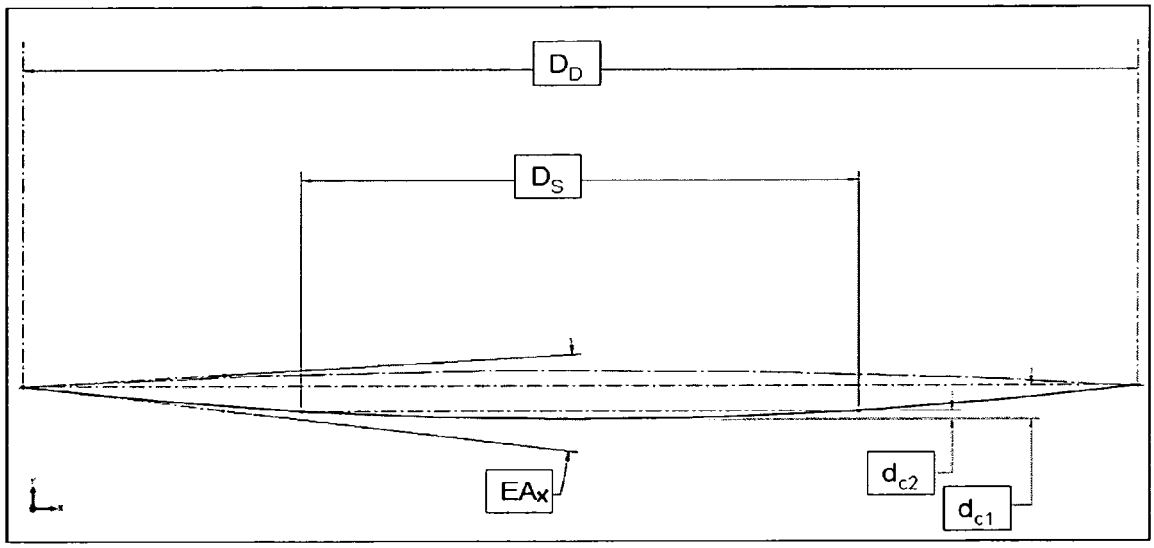
FIG. 5 is a schematic of the circle ratio of a dimple.
Figure 6:
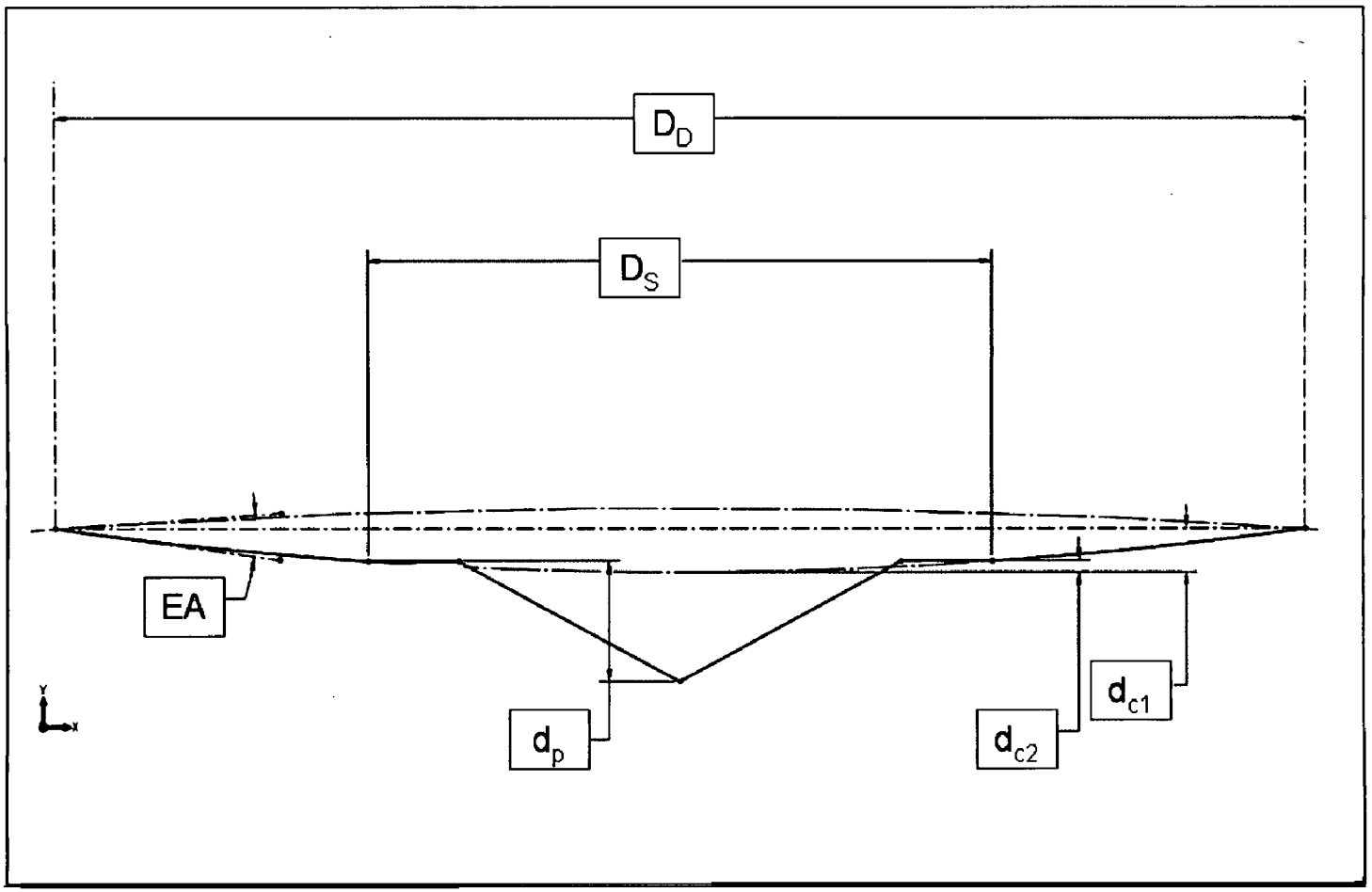
FIG. 6 is a schematic indicating edge angle and depth of the prismatoid.

Examples of circle ratios are shown in FIGS. 3 and 4, wherein circle ratios of 0.25 and 0.90 are respectively depicted, and a schematic of the ratios is illustrated in FIG. 5.

Depending on whether the prismatoid is a depression or protrusion, the volume is a summation from the initial dimple extent, and to calculate for the two discrete geometries is generally done using a CAD package to accurately compute the dimple volume.

The chordal volume of the entire dimple, $V_D$ is then:

$$V_D=V_E+V_P \qquad \text{Equation 4}$$

where $V_E$ is the dimple extent volume and $V_P$ represents the volume of the prismatoid.

The dimple volume, $V_D$, must be such that each dimple maintains an effective theoretical edge angle (EAx). The effective theoretical edge angle is determined by computing the equivalent spherical dimple edge angle EA with dimple volume $V_D$ on a golf ball with a diameter ($D_B$). The dimple diameter ($D_D$) is the weighted average for the specific pattern.

Figure 7:
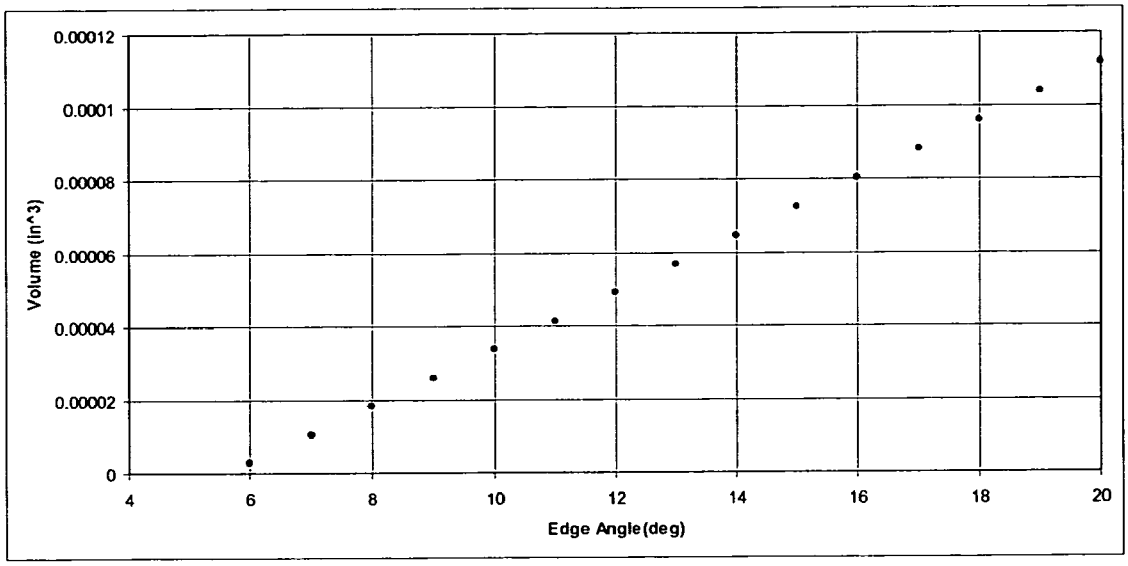
FIG. 7 is a chart of edge angle versus dimple volume.

For a given dimple diameter, the chordal volume has a linear relationship to the edge angle of the dimple ($R^2=1$). For an average dimple diameter of 0.165 inches, a plot of edge angle versus dimple volume is shown in FIG. 7. It is to be appreciated that the edge angle is the sum of the chordal and cap angles. When the chordal angle is zero, the chordal volume is also zero and the edge angle is equal to the cap angle. Thus, this type of plot is only true for edge angles greater than the cap angle for a given dimple diameter (for FIG. 7 the edge angle is 5.64°). The plot shows the linear relationship between chordal volume and edge angle, which is instrumental in determining the effective edge angle.

The effective theoretical edge angle is determined by first computing the slope of the line relating chordal volume to dimple edge angle for the weighted average dimple diameter ($D_D$). This is calculated as the ration of cap volume $V_C$ to cap angle $A_C$ as seen in equation 5.

$$m = \frac{V_C}{A_C} \qquad \text{Equation 5}$$

The effective theoretical edge angle EAx is calculated as the ratio of the volume $V_D$ to the slope plus the included cap angle, as shown is equation 6.

$$EA = \frac{V_D}{m} + A_C \qquad \text{Equation 6}$$

The dimple is designed such that the effective theoretical edge angle EAx is:

$$9°<EAx<18° \qquad \text{Equation 7}$$

more preferably:

$$12°<EAx<16° \qquad \text{Equation 8}$$

While various descriptions of the present invention are described above, it is understood that the various features of the embodiments of the present invention shown herein can be used singly or in combination thereof. This invention is also not to be limited to the specifically preferred embodiments depicted therein.

What is claimed is:

1. A golf ball having recessed dimples on the surface thereof, wherein at least one dimple comprises:

two discrete geometries that are surrounded by a first circular perimeter; and one of the discrete geometries comprises a prismatoid depression or protrusion surrounded by a smaller, second circular perimeter that is circumscribed within the first, and is in contact with all prismatoid vertices, wherein the aerodynamic flight characteristics of the golf ball are further tuned.

2. The golf ball according to claim 1, wherein the depressions or protrusions are based on a polyhedral prismatoid.

3. The golf ball according to claim 1, wherein the base of the prismatoid maintains a minimum of three and a maximum of twelve edges.

4. The golf ball according to claim 1, wherein a ratio of diameters of the first and second circular perimeters is defined by:

$$r_c = \frac{D_S}{D_D}$$

wherein:

rc is the circle ratio $D_D$ is the diameter of the first circular perimeter $D_S$ is the diameter of the second circular perimeter.

5. The golf ball according to claim 4, wherein the range of values for rc is about 0.25 to about 0.90.

6. The golf ball according to claim 5, wherein each dimple maintains an effective theoretical edge angle controlled by the dimple volume.

7. The golf ball according to claim 6, wherein the effective theoretical edge angle is equal to or greater than 9° and equal to or less than 18°.

8. The golf ball according to claim 7, wherein the effective theoretical edge angle is equal to or greater than 12° and equal to or less than 16°.

* * * * *